United States Patent [19]

Penn

[11] Patent Number: 5,005,732

[45] Date of Patent: Apr. 9, 1991

[54] OIL CAN SPOUT WITH FLOW CONTROL

[76] Inventor: Henry E. Penn, 12300 Highway 67, Lakeside, Calif. 92040

[21] Appl. No.: 503,762

[22] Filed: Apr. 3, 1990

Related U.S. Application Data

[63] Continuation-in-part of Ser. No. 427,760, Oct. 27, 1989, abandoned.

[51] Int. Cl.[5] ..... B67D 5/00

[52] U.S. Cl. ..... 222/91; 222/523; 222/525; 222/81

[58] Field of Search ..... 222/522–525, 222/568, 81, 91, 80

[56] References Cited

U.S. PATENT DOCUMENTS 1,925,466 9/1933 Simpson ..... 222/81
2,393,103 1/1946 Groedel ..... 222/80 X
3,844,455 11/1972 Stull ..... 222/499
4,927,065 5/1990 Beck ..... 222/520

FOREIGN PATENT DOCUMENTS 567291 10/1957 Italy ..... 222/80

*Primary Examiner*—Michael S. Huppert
*Assistant Examiner*—Anthoula Pomrening
*Attorney, Agent, or Firm*—Henri J. A. Charmasson

[57] ABSTRACT

A spout, adapted for attachment to an oil can or the like, has a generally tubular configuration. A tubular sleeve permits partial or total occlusion of the flow of liquid by axially moving the sleeve portion. Thus the spout may be closed before turning the oil can over for pouring the oil into an engine, then releasing the flow of oil when the spout is safely engaged into the engine crankcase inlet. Six embodiments of the invention are disclosed.

4 Claims, 4 Drawing Sheets

OIL CAN SPOUT WITH FLOW CONTROL

PRIOR APPLICATION

This application is a continuation-in-part of co-pending application Ser. No. 07/427,760 filed Oct. 27, 1989, and now abandoned.

BACKGROUND OF THE INVENTION

This invention relates to spouts and to flow control valves.

Every automobilist has experienced frustration when trying to add oil to an engine. Oil cans and oil flasks do not come with convenient pouring spouts that would aim the flow of oil directly into the crankcase inlet and avoid any spilling of oil over the engine. In many automobiles, the crankcase oil inlet is surrounded by equipment that forces the automobilist to pour the oil from a certain distance above the crankcase inlet. The only practical way to do so without spilling any oil is to use a long funnel. However, this type of article is not always handy; especially when oil has to be added to an engine at roadside. The funnel needs to be cleaned then stored at the expense of available storage space.

What is needed is a controllable spout that can be quickly mounted on an oil can, or could be formed as an integral part of a plastic oil can flask.

SUMMARY OF THE INVENTION

The principal and secondary objects of the invention is to provide an inexpensive and easily operable flow control device which can be adapted for use with an oil can, oil flask or any other liquid container that must be poured into a hard-to-reach inlet. The flow control device need not be absolutely watertight or capable of withstanding high fluid pressure, but be so simple and inexpensive to manufacture that it can be disposed with the empty container. The spout has a sealable outlet, so that it is not necessary to remove it from a partially-emptied container. The flow control device is provided by specially configured folds in a section of the spout which allows for axial movement of the section in a manner that causes a partial or total interruption of the flow of liquid.

DESCRIPTION OF THE PREFERRED EMBODIMENTS OF THE INVENTION

Figure 1:
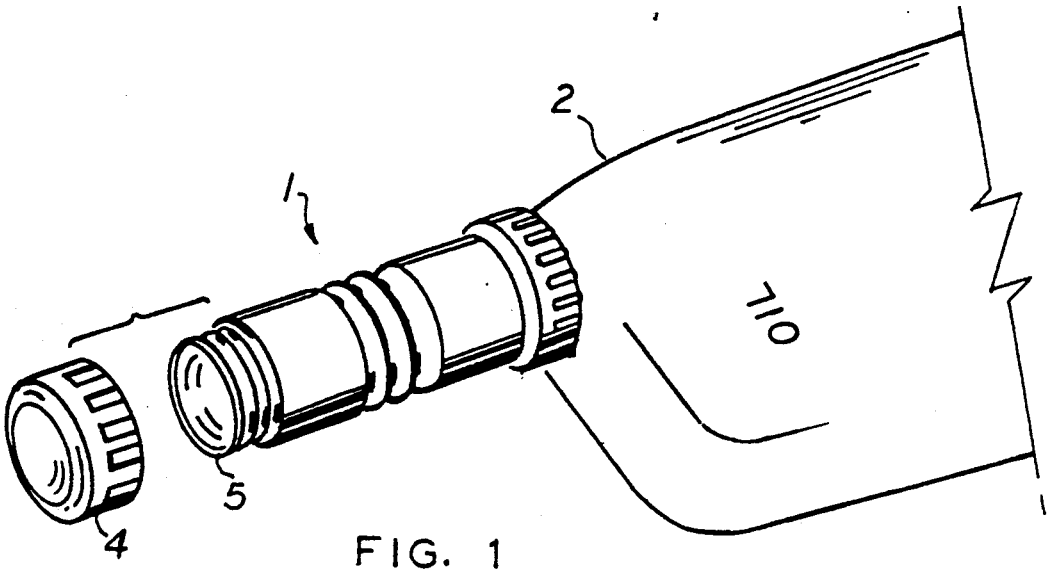
FIG. 1 is a perspective view of a first embodiment of the invention shown mounted on the outlet of an oil flask.
Figure 2:
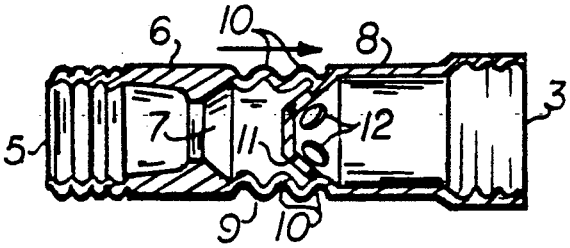
FIG. 2 is a longitudinal cross-sectional view thereof.

Referring now to the drawing, there is illustrated in FIGS. 1 and 2 a first embodiment of the invention.

A pouring spout 1 is mounted on an oil flask 2. The inlet of the spout is shaped and threaded to screw on the outlet of the oil flask 2 in lieu of its cap 4. The outlet 5 of the spout has the same shape and dimension as the outlet of the oil flask 2 so that the cap 4 can be screwed directly thereon. Thus, if the oil flask 2 is only partially emptied, the spout can remain in place with the inlet 3 at the proximal end screwed upon the oil flask 2, and the combination safely sealed by screwing the oil flask cap 4 to close the outlet 5 at the distal end of the spout 1.

The spout is a generally cylindrical conduit comprising a first 6 with an inner central aperture defining a port 7, a element 8 is joined to the first element 6 by a resilient portion 9 of the conduit. The wall of the resilient portion defines a plurality of accordion folds which allow axial movement of the first element 6 in relation to the other element 8. A central stopper 11 projects from the second element 8 into the resilient portion 9 and toward the first element 6. When the first element 6 is axially moved back toward the second element 8, the stopper 11 engages and closes the port 7. When the first element 6 is in the rest position illustrated in FIG. 2, bores 12 in the periphery of the stopper allow the oil to flow through the spout.

The spout 1 is made of plastic material or the like and the thickness of the wall of the tubular conduit is decreased in the folded portion 9 to provide flexibility. The folds 10 are in planes generally normal to the axis of the conduit.

Figure 3:
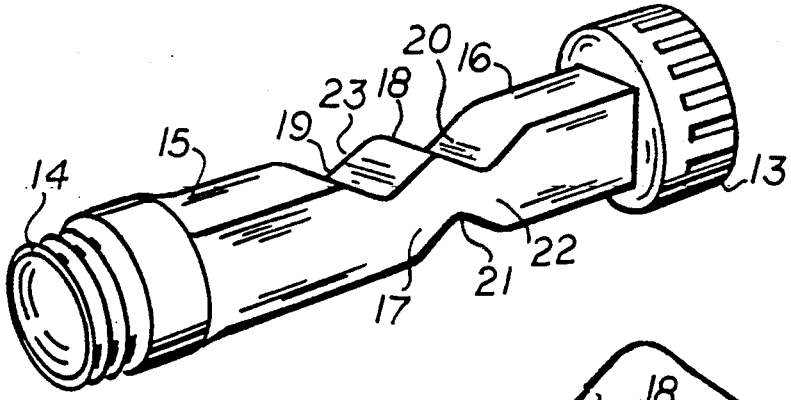
FIG. 3 is a perspective view of a second embodiment of the invention.
Figure 4:
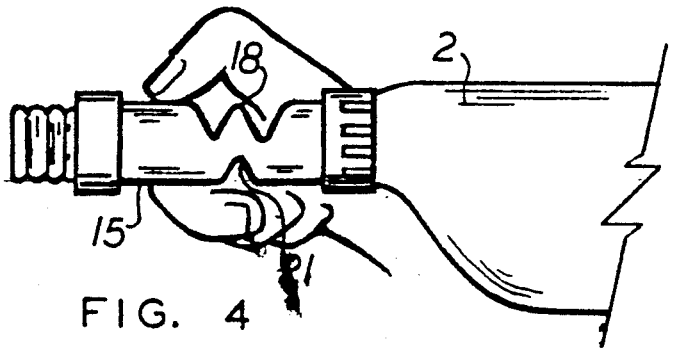
FIG. 4 illustrates the closing movement thereof.

A second embodiment of the invention is illustrated in FIGS. 3 and 4. While the inlet 13 and outlet 14 are similar to those in the first embodiment, the first element 15, second element 16 and the folded, resilient, central portion 17 have a generally square or parallelogrammic cross-section. In the top wall of the central section 17 a double fold forms a convex zone 18 between two concave areas 19, 20. In the opposite, bottom wall of the central section a single fold forms a concave zone 21 located immediately below the convex zone 18 of the top wall.

As illustrated in FIG. 4, when the first element 15 is moved axially toward the second element 16, the central portion 17 constricts, and the concave zone 21 nests into the convex zone 18. This movement restricts and eventually completely interferes with the flow of liquid through the spout. It should be understood that in order for this embodiment to work effectively, the lateral walls 22, 23 of the central portion 17 must be flexible enough to convexly bend in order to bring the bottom wall in the concave zone 21 in contact with the top wall of the convex zone 18. Alternatively, the central section 17 could be pinched to bring the convex and concave zones together and close the spout.

Figure 5:
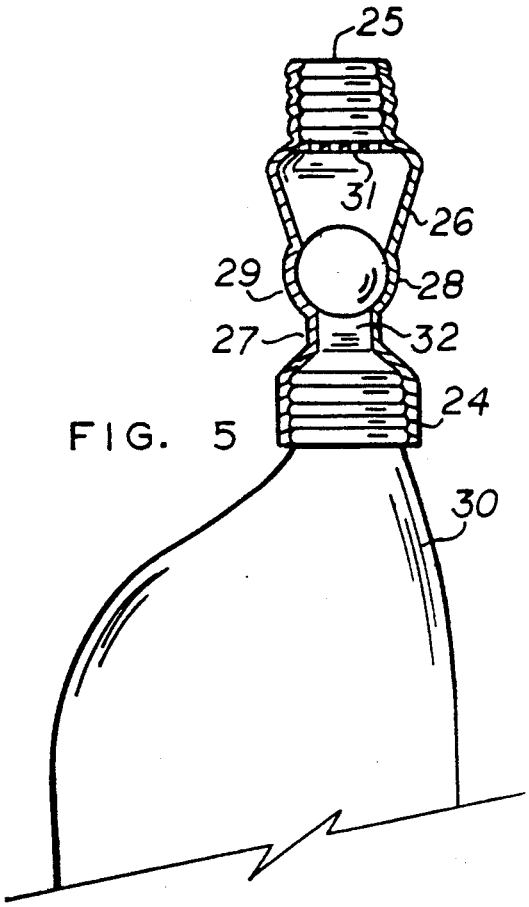
FIG. 5 is a partial, longitudinal, cross-sectional view of a third embodiment of the invention mounted on the outlet of an oil flask.
Figure 6:
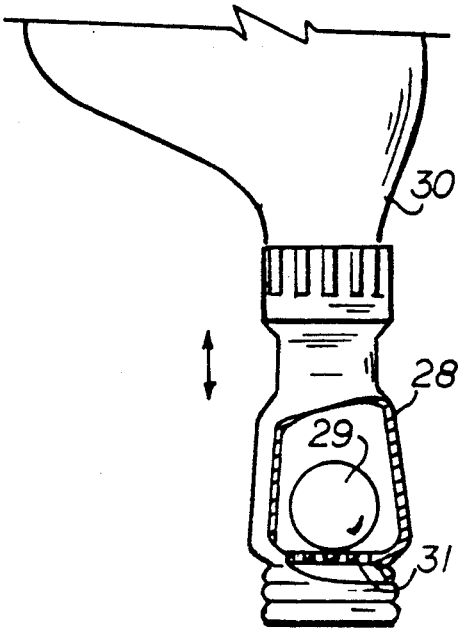
FIG. 6 is a side view thereof with cutout showing the internal mechanism in the open position.

FIGS. 5 and 6 illustrate a third embodiment of the invention. Here again, the inlet 24 and 25 are similar to those in the first and second embodiments. An enlarged first element 26 is separated from a narrower second element 27 by a foldable central portion 28. In the folded position the central portion 28 captures a ball stopper 29 which interferes with the flow of liquid through the spout. When the oil flask 30 and the spout are turned upside-down as shown in FIG. 6, and the central portion 28 is stretched as illustrated, the ball stopper 29 drops against a grid 31 which separates the enlarged second element 26 from the outlet 25; thus allowing liquid to flow around the stopper and through the grid 31. The flow may be interrupted by allowing the central portion 28 to resume its normal folded configuration, and by squeezing the enlarged element 26 to force the ball stopper 29 into the position illustrated in FIG. 5. Alternately, the flask and spout can be returned to the standing position before the cental portion 28 is allowed to retract into a folded position capturing and immobilizing the ball stopper against the port 32 formed by the narrow element 27.

Figure 7:
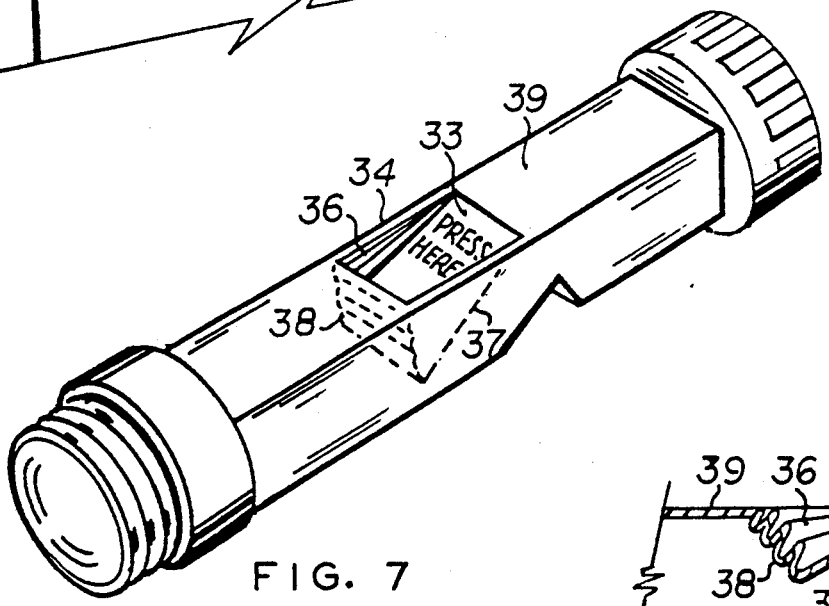
FIG. 7 is a perspective view of a fourth embodiment of the invention.
Figure 8:
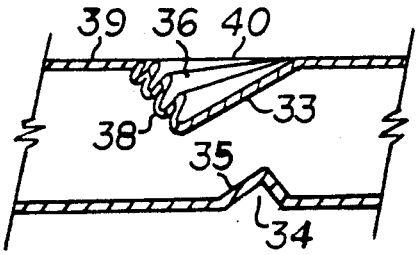
FIG. 8 is a partial, longitudinal, cross-sectional view of the flow control section thereof.

A fourth embodiment is illustrated in FIG. 7 and 8 wherein the occlusion of the spout is achieved by depressing a collapsible section 33 of the central portion 34. The central portion has a parallelogrammic cross-section, and a concave fold 34A is formed in the wall opposite the collapsible section 33. When the under surface of the collapsible section 33 comes into contact with the inner surface 35 of the concave fold 34A, the flow of liquid through the spout is interrupted. The sides 36, 37 and 38 of the collapsible section 33 are connected to the top wall 39 by a bellowed membrane 40 which can be formed as part of the molding process for the entire spout.

Figure 9:
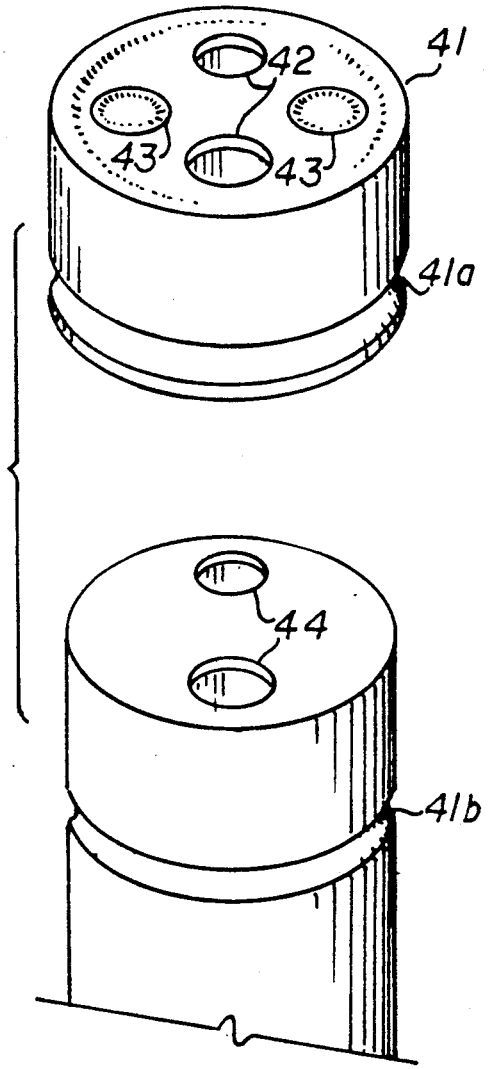
FIG. 9 is a perspective view of the fifth embodiment of the invention.
Figure 10:
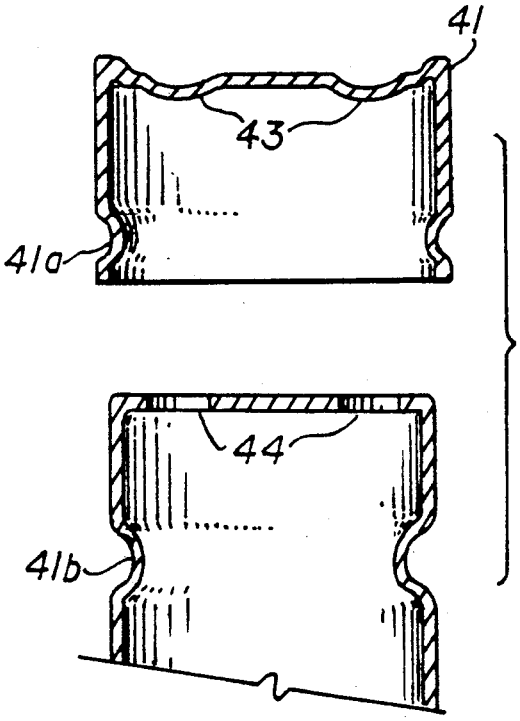
FIG. 10 is a longitudinal, cross-sectional view thereof.
Figure 11:
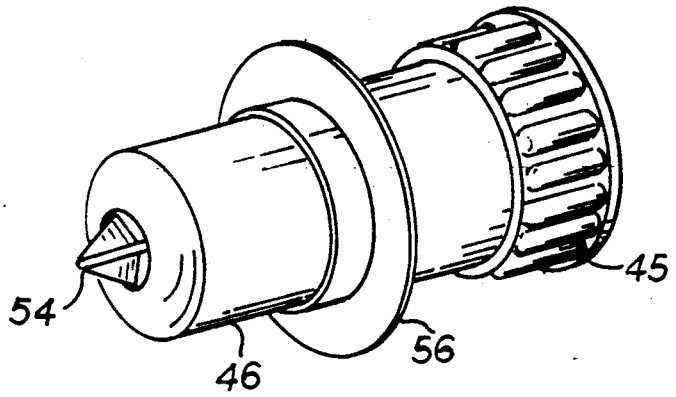
FIG. 11 is a perspective view of the sixth embodiment of the invention.
Figure 12:
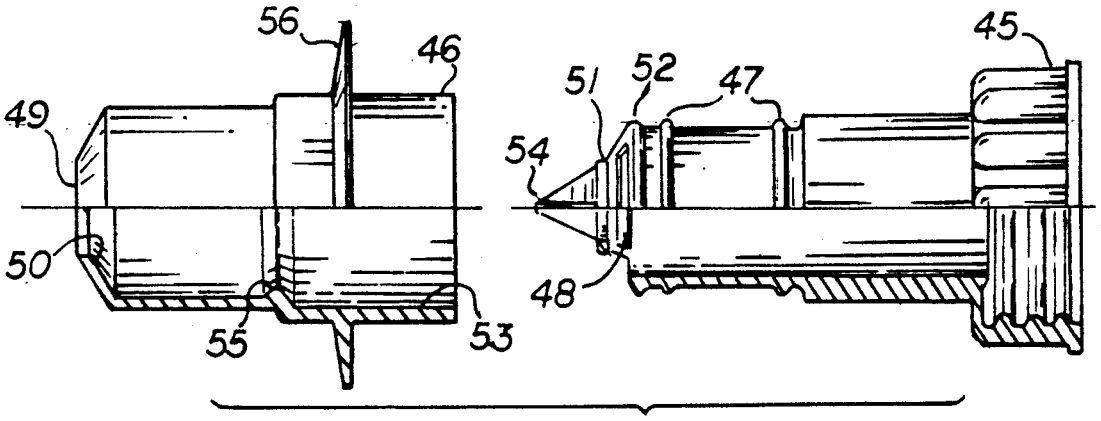
FIG. 12 is an exploded, elevational, view of the exterior sleeve and interior stem with a section cutout showing the interiors thereof.
Figure 13:
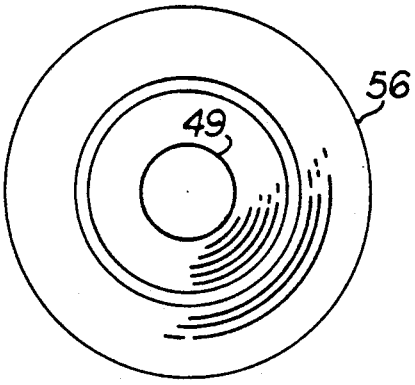
FIG. 13 is a top plan view of the exterior sleeve.
Figure 14:
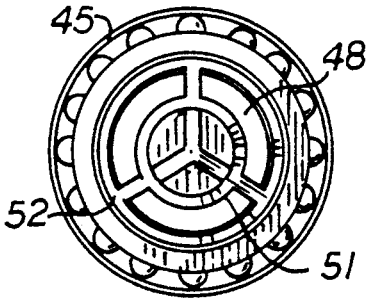
FIG. 14 is a top plan view of the interior stem.

A fifth embodiment is illustrated in FIGS. 9 and 10, wherein the occlusion of the spout is achieved by rotating a cap 41 containing two holes 42 and two nipples 43, until the nipples engage two holes 44 in the distal end of the spout.

Opening of the spout is achieved by bringing the two holes 42 of the cap 41 into alignment with the two holes 44 of the bottle. The cap is force-fitted and held in place by the ring depression 41*a* at the base of the cap engaging the circular groove 41*b* in the neck of the spout.

A sixth embodiment of the invention is illustrated in FIG. 11, 12, 13 and 14, wherein the spout comprises two parts; a main stem 45, and a sliding sleeve 46. The sleeve is axially movable along the stem between two detent rings 47 annular grooves 47 which receive the inner ridge 55 of the sleeve at either end of its axial travel. In the open position the oil may enter the spout through the proximal end, passes through a diverter grate 48 in the distal end of the stem, and exits through the hole 49 in the end of the sleeve. The occlusion of the spout is achieved by sliding the sleeve along the stem toward the proximal end, bringing the beveled edge 50, of the hole 49, in the sleeve, into contact with a beveled seat 51, on the distal end of the stem, thus obstructing the flow of oil through the grate 48. An annular bead 52 around the distal end of the stem 45 is sized to be in frictional contact with the inside wall 53 of the sleeve 46, effectively sealing the device against oil slippage between the stem and sleeve.

A pointed tip 54 at the distal end of the stem 45 is provided as a tool for puncturing the foil safety seal found on some oil flasks prior to mounting the spout. A skirt or flange 56 extends radially and outwardly around the sleeve 46 at the mid-length in order to facilitate the manual grabbing and axial moving of the sleeve.

With each embodiment, the spout can be left on the empty container until used again, to keep the oil from becoming dirty. When the spout is to be reused, it is unscrewed from the empty container and screwed onto the new oil container after removing the empty oil container cap from the spout.

It should be understood that while in the six described embodiments, the inlets are adapted for attachment to the outlet of an oil flask, and the outlets are configured to accept a sealing cap, the inlet of each embodiment could be shaped and dimensioned to adapt to any kind of container including a typical oil can, and the outlets could be shaped for insertion into any kind of container.

While the preferred embodiments of the invention have been described, modifications can be made and other embodiments may be devised without departing from the spirit of the invention and the scope of the appended claims.

What is claimed is:

1. In combination with a liquid container having a pouring orifice, a controllable spout which comprises:

a generally tubular conduit having an inlet at a proximal end and an outlet at a distal end;

said inlet being shaped and dimensioned to mate with said pouring orifice;

said tubular conduit having a gating section comprising a tubular sleeve axially movable between two locking positions, and dimensioned to affect the flow of liquid through the distal end of said conduit when moved between said positions, wherein said tubular sleeve has a bore on the distal end, said bore being surrounded by a beveled inner annular surface; and a projection extending on the distal end of said tubular conduit through and beyond said bore to form a sharply pointed tip, the periphery of said projection defining a beveled outer annular surface shaped and dimensioned to intimately contact said inner annular surface.

2. The combination of claim 1, wherein the proximal end of said conduit defines a knurled finger grip.

3. The combination of claim 1, wherein the tubular sleeve comprising a peripheral flange projecting radially and outwardly from a mid-length section of the sleeve's outer surface.

4. The combination of claim 1, wherein said tubular conduit comprises two spaced-apart outer annular grooves, and said tubular sleeve comprises an inner annular ridge shaped and dimensioned to engage said annular grooves.

* * * * *